United States Patent [19]

Cundiff, Jr.

[11] 4,109,759

[45] Aug. 29, 1978

[54] EMERGENCY EXIT DEVICE

[75] Inventor: Otha G. Cundiff, Jr., Pontiac, Mich.

[73] Assignee: The Raymond Lee Organization, Inc., New York, N.Y. ; a part interest

[21] Appl. No.: 765,734

[22] Filed: Feb. 4, 1977

[51] Int. Cl.[2] ..... A62B 1/20

[52] U.S. Cl. ..... 182/19; 182/18; 182/20; 182/48

[58] Field of Search ..... 182/48, 20, 18, 19; 49/37; 14/69.5, 71.1

[56] References Cited

U.S. PATENT DOCUMENTS

| | | | |
|---|---|---|---|
| 508,835 | 11/1893 | Piepenbring | 49/37 |
| 1,141,716 | 6/1915 | Kjellstrom | 182/18 |
| 3,392,380 | 7/1968 | Fordyce | 182/18 |
| 3,738,450 | 6/1973 | Hessler | 182/48 |

FOREIGN PATENT DOCUMENTS

| | | | |
|---|---|---|---|
| 2,340,824 | 2/1975 | Fed. Rep. of Germany | 49/37 |

*Primary Examiner*—Reinaldo P. Machado
*Attorney, Agent, or Firm*—Daniel Jay Tick

[57] ABSTRACT

A doorway type opening is formed through the outside wall of a building. A door device is hingedly affixed to the building at the lower edge of the opening and has a plurality of telescoping sections juxtaposed when the door device is closed and forming an extended planar incline when the door device is opened. Thus, the door device when open supports people leaving the building via the opening and functions as a slide to conduct them to the ground. A door control device affixed to the door device and the building lowers one end of the door device to the ground supporting the door device in its extended open condition from the lower edge of the opening to the ground and supports the door device in its closed condition as a door openable only from inside the building.

3 Claims, 4 Drawing Figures

EMERGENCY EXIT DEVICE

BACKGROUND OF THE INVENTION

The present invention relates to an emergency exit device. More particularly, the invention relates to an emergency exit device for a building having an outside wall.

Objects of the invention are to provide an emergency exit device of simple structure, which is inexpensive in manufacture, installed with facility and convenience in new and existing buildings, and functions efficiently, effectively and reliably to permit people to escape from the first, second, third or fourth floor of a building in an emergency, and, at the same time, prevents unauthorized entry into the building.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
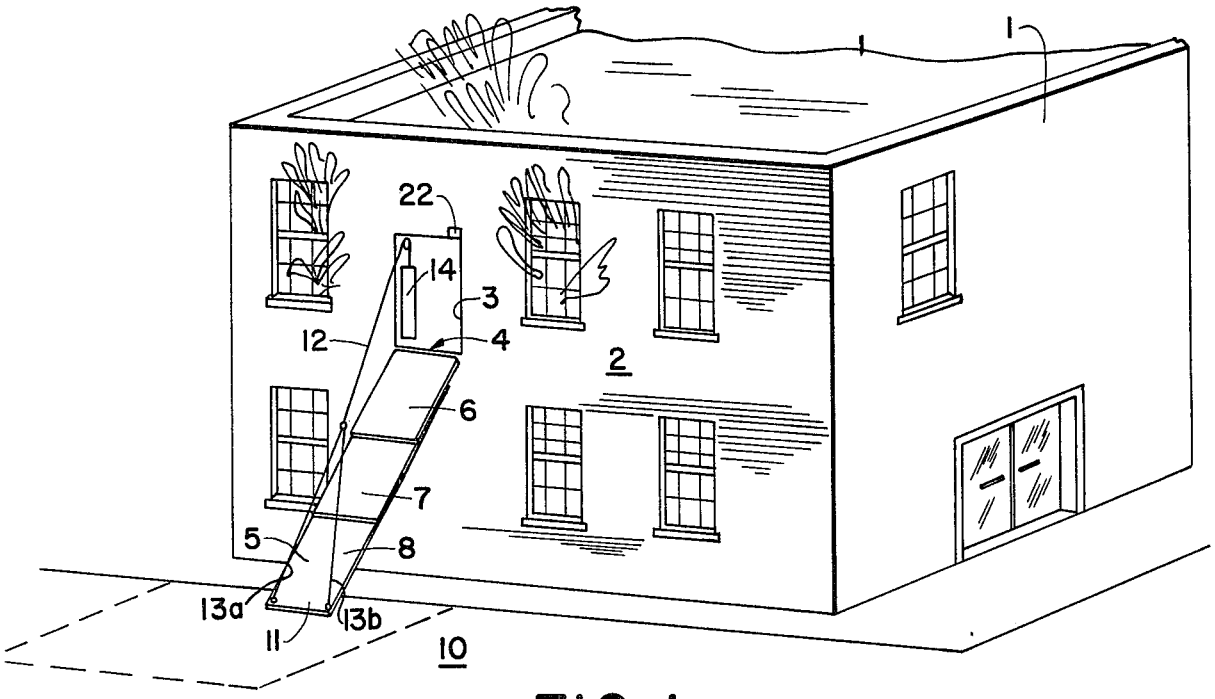
FIG. 1 is a perspective view of an embodiment of the emergency exit device of the invention in open condition for use.
Figure 2:
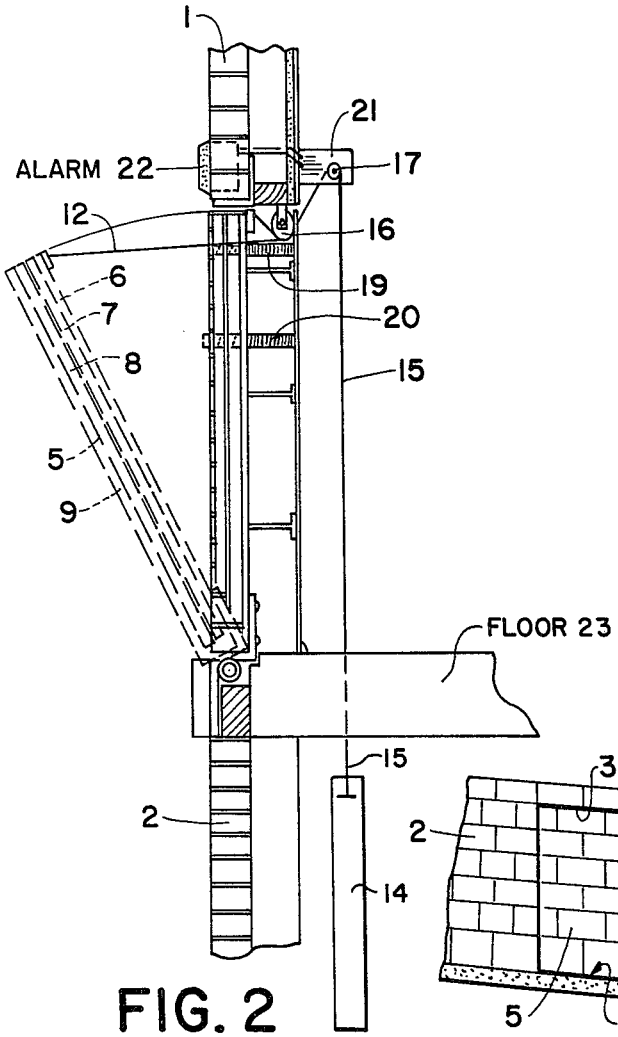
FIG. 2 is a view, on an enlarged scale, partly in section, illustrating an embodiment of the door device and an embodiment of the door control device of the invention.
Figure 4:
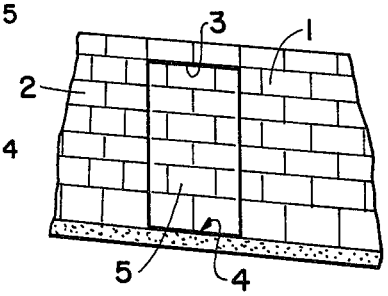
FIG. 4 is a view of a door device of the invention from outside the building.

The emergency exit device of the invention is for a building 1 having an outside wall 2 (FIGS. 1, 2 and 4).

The emergency exit device of the invention comprises a doorway type opening 3 (FIGS. 1 and 4) formed through the outside wall 2 of the building. The opening 3 has a lower edge 4 (FIGS. 1 and 4).

A door device 5 (FIGS. 1, 2 and 4) is hingedly affixed to the building 1 at the lower edge 4 of the opening 3. The door device 5 has a plurality of telescoping sections 6, 7, 8 (FIGS. 1 and 2) and 9 (FIG. 2) substantially juxtaposed when the door device is closed, as shown in FIGS. 2 and 4. The telescoping sections 6, 7, 8, and 9 form an extended substantially planar incline, as shown in FIG. 1, when the door device is opened, whereby said door device, when open, supports people leaving the building via the opening and functions as a slide to conduct such people to the ground 10.

A door control device is affixed to the door device 5 and the building for lowering one end 11 of the door device to the ground 10 (FIG. 1). This supports the door device in its extended open condition, as shown in FIG. 1, from the lower edge 4 of the opening 3 to the ground 10. The door device is supported by the door control device as a door openable only from inside the building, when the door device is in its closed condition.

Figure 3:
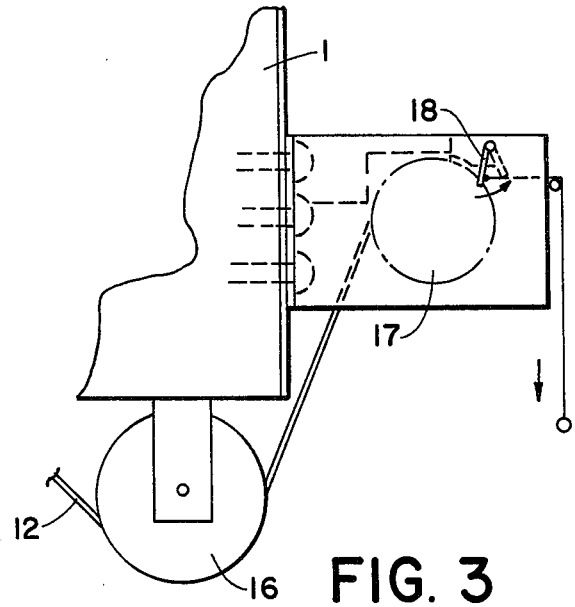
FIG. 3 is a view, on an enlarged scale, of part of the door control device of FIG. 2.

The door control device comprises a cable 12 (FIGS. 1, 2 and 3) separated into two lengths 13a and 13b near the end 11 of the door device 5 and affixed at its ends 13a and 13b to the end 11 of said door device 5, as shown in FIG. 1. The cable 12 has a weight 14 affixed to its other end 15 inside the building (FIG. 2). The cable 12 is supported by a pair of pulleys, rollers or wheels 16 and 17 (FIGS. 2 and 3) inside the building 1.

The wheel 17 is normally locked in position by a locking device 18 (FIGS. 3) which is manually released when it is desired to open the door device 5. The weight 14 functions as a counterbalance. The weight 14 is below the level of the floor 23, as shown in FIG. 2, when the door device 5 is closed. When the door device 5 is fully extended and in contact with the ground 10, the weight 14 is at the pulley 17, as shown in FIG. 1. Springs 19 and 20 push the door device 5 out from the building when the wheel 17 is released.

An alternative to the manual release 18 for the wheel 17 is a heat sensing device 21 coupled to such lock device in a manner whereby when the temperature in the building exceeds a predetermined level, indicating a fire in the building, the wheel 17 is automatically released (FIG. 2).

A buzzer, bell, or other suitable audible alarm device 22 (FIGS. 1 and 2) is mounted outside the building at the opening 3 to sound an alarm when the heat sensing device 21 detects a temperature above the predetermined temperature, thereby indicating that there is a fire in the building.

While the invention has been described by means of a specific example and in a specific embodiment, I do not wish to be limited thereto, for obvious modifications will occur to those skilled in the art without departing from the spirit and scope of the invention.

I claim:

1. An emergency exit device for a building having an outside wall and at least two floor levels, said exit device comprising a doorway type opening formed through the outside wall on an upper floor level of the building, said opening having a lower edge;

door means hingedly affixed to the building at the lower edge of the opening, said door means having a plurality of telescoping sections substantially juxtaposed when said door means is closed and forming an extended substantially planar incline when said door means is opened whereby said door means when open supports people leaving the building via the opening and functions as to slide to conduct them to the ground; and door control means affixed to the door means and the building for lowering one end of the door means to the ground supporting the door means in its extended open condition from the lower edge of the opening to the ground and for supporting the door means in its closed condition as a door openable only from inside the building, said door control means comprising a cable affixed at one end to the door means, pulley means inside the building supporting the cable, said pulley means including a lockable pulley supporting the cable and lockable in position to prevent movement of said cable, and a weight affixed to the other end of the cable and functioning as a counterbalance to said door means.

2. An emergency exit device as claimed in claim 1, further comprising manually operable lock means in operative proximity with said lockable pulley for selectively securing and releasing the cable for movement.

3. An emergency exit device as claimed in claim 1, further comprising temperature-operable lock means in operative proximity with said lockable pulley for releasing the cable for movement when the temperature in the area of said lock means exceeds a predetermined magnitude.

* * * * *